US010258114B2

(12) United States Patent
Sho et al.

(10) Patent No.: US 10,258,114 B2
(45) Date of Patent: Apr. 16, 2019

(54) STRINGERS WITHOUT FASTENER TAPE AND ARTICLE WITH SLIDE FASTENER

(71) Applicant: YKK Corporation, Tokyo (JP)

(72) Inventors: Yoshiyuki Sho, Toyama (JP); Makoto Saito, Toyama (JP)

(73) Assignee: YKK Corporation (JP)

( * ) Notice: Subject to any disclaimer, the term of this patent is extended or adjusted under 35 U.S.C. 154(b) by 615 days.

(21) Appl. No.: 14/765,105

(22) PCT Filed: Dec. 16, 2013

(86) PCT No.: PCT/JP2013/083604

§ 371 (c)(1),
(2) Date: Jul. 31, 2015

(87) PCT Pub. No.: WO2014/119150

PCT Pub. Date: Aug. 7, 2014

(65) Prior Publication Data

US 2015/0366300 A1 Dec. 24, 2015

(30) Foreign Application Priority Data

Jan. 31, 2013 (WO) ..... PCT/JP2013/052237

(51) Int. Cl.
*A44B 19/12* (2006.01)
*A44B 19/40* (2006.01)
*A44B 19/34* (2006.01)

(52) U.S. Cl.
CPC ..... *A44B 19/406* (2013.01); *A44B 19/12* (2013.01); *A44B 19/343* (2013.01);
(Continued)

(58) Field of Classification Search
CPC ..... A44B 19/12; A44B 19/406; A44B 19/346; A44B 19/343; A44B 19/40
(Continued)

(56) References Cited

U.S. PATENT DOCUMENTS 3,302,259 A * 2/1967 Waldes ..... A44B 19/04 24/408
3,783,476 A * 1/1974 Frohlich ..... A44B 19/406 24/394
(Continued)

FOREIGN PATENT DOCUMENTS

GB 1236456 A 6/1971
JP 36-003037 B1 4/1961
(Continued)

OTHER PUBLICATIONS

International Search Report, PCT Application No. PCT/JP2013/083604, dated Mar. 18, 2014.

*Primary Examiner* — Abigail E Troy
(74) *Attorney, Agent, or Firm* — Kilpatrick Townsend & Stockton LLP

(57) ABSTRACT

Stringers without fastener tape have continuous fastener elements and have element fixing members wherein the fastener elements are sewn together by a sewing thread. The element fixing members are inserted between upper and lower leg sections of the fastener elements. The sewing thread comes in contact with and straddles the upper and lower leg sections of each fastener element and pierces the element fixing members between the fastener elements. As a result of such stringers without fastener tape, the fastener elements can be held and the weight and cost of an article with a slide fastener can be reduced.

8 Claims, 9 Drawing Sheets

(52) U.S. Cl.
CPC ..... *A44B 19/346* (2013.01); *A44B 19/40* (2013.01); *Y10T 24/2521* (2015.01); *Y10T 24/2527* (2015.01)

(58) Field of Classification Search
USPC ..... 24/394
See application file for complete search history.

(56) References Cited

U.S. PATENT DOCUMENTS

| | | | | | |
|---|---|---|---|---|---|
| 4,319,387 | A * | 3/1982 | Yoshida | A44B 19/12 | 24/394 |
| 4,888,859 | A * | 12/1989 | Horita | A44B 19/12 | 24/389 |
| 5,983,465 | A | 11/1999 | Wakai et al. | | |
| 2010/0107374 | A1 * | 5/2010 | Nakayama | A44B 19/12 | 24/399 |

FOREIGN PATENT DOCUMENTS

| | | | |
|---|---|---|---|
| JP | 038404/1974 | | 4/1974 |
| JP | 11-070007 | A | 3/1999 |
| JP | 2006-247279 | A | 9/2006 |
| WO | 2011-111154 | A1 | 9/2011 |
| WO | 2012-070116 | A1 | 5/2012 |

* cited by examiner

STRINGERS WITHOUT FASTENER TAPE AND ARTICLE WITH SLIDE FASTENER

This application is a national stage application of PCT/JP2013/083604 which claims priority to PCT/JP2013/052237, both of which are incorporated herein by reference.

TECHNICAL FIELD

The invention relates to an article with a stringer without fastener tape of which continuous fastener elements formed of a mono filament are fixed to a narrow element fixing member, and an article with a slide fastener affixed thereto having the stringer without fastener tape.

BACKGROUND ART

A slide fastener is generally used as an opening and closing tool of an article such as clothes, daily sundries, industrial materials and the like or an article such as various seats of a vehicle, a train, an airplane and the like. In general, the slide fastener used for an opening and closing part of the various articles has a pair of fastener stringers each of which has an element row formed at a tape side edge portion of a fastener tape, and a slider arranged to be slidable along the element rows.

As a representative example of the fastener stringer, a fastener stringer of which continuous fastener elements are formed into a coil shape or zigzag shape by a mono filament of a thermoplastic resin and have a plurality of engaging heads continuously connected into one has been known. In the fastener stringer, the continuous fastener elements are sewn and fixed to one side edge portion (element attachment portion) of a woven or knitted fastener tape by a sewing thread, so that an element row is formed.

An example of a slide fastener of which the element rows are formed by the continuous fastener elements is disclosed in Japanese Patent Application Publication No. 2006-247279A (Patent Document 1).

As shown in FIG. 13, a slide fastener 100 disclosed in Patent Document 1 has a pair of fastener stringers 103 of which continuous fastener elements 101 are sewn to element attachment portions arranged at one side edges-side of fastener tapes 102 by sewing threads, and a slider 104 attached to element rows of the continuous fastener elements 101. In this case, the fastener tape 102 has a wide tape main body portion and the element attachment portion arranged at one side edge-side (inner side edge-side) of the tape main body portion.

Also, when sewing the slide fastener 100 to an article such as clothes, which is a fastener-attached member, the sewing is performed by a sewing machine at a state where the tape main body portion of the fastener tape 102 (i.e., an exposed tape portion extending towards an outward direction of the continuous fastener elements 101, when seeing the fastener stringer 103 from an upper surface on which the continuous fastener elements 101 are arranged) and an opening and closing part (opening peripheral edge portion) becoming a fastener attachment part of the article are superimposed.

Also, for example, International Patent Application Publication No. WO2012/070116 (Patent Document 2) and WO2011/111154 (Patent Document 3) disclose a slide fastener having an improved fastener tape.

For example, as shown in FIG. 14, Patent Document 2 discloses a fastener stringer 110 for a slide fastener in which a fastener tape 111 extends beyond end edges of continuous fastener elements 112 on a connecting part-side and an extension length (X) is set to be smaller than 12 mm.

According to the fastener stringer 110 of Patent Document 2, when attaching the fastener stringer 110 to an article with the fastener tape 111 being bent, it is possible to accomplish an effect capable of keeping the tape main body portion of the fastener tape 111 to be substantially flat even when the fastener tape 111 is bent and stably sewing the fastener stringer 110.

Also, as shown in FIG. 15, Patent Document 3 discloses a fastener stringer 120 for a slide fastener in which an element row formed by continuous fastener elements 121 is wrapped by a fastener tape 122. When configuring the slide fastener by using the fastener stringer 120 of Patent Document 3, it is possible to conceal the element rows by the fastener tape 122 so that the element rows are not seen from an outside, without using a covering member upon engagement of right and left element rows. Therefore, it is possible to improve an appearance of an article with the slide fastener affixed thereto.

PRIOR ART DOCUMENT

Patent Document

Patent Document 1: Japanese Patent Application Publication No. 2006-247279A

Patent Document 2: International Patent Application Publication No. WO2012/070116

Patent Document 3: International Patent Application Publication No. WO2011/111154

SUMMARY OF INVENTION

Problems to be Solved by Invention

In recent years, for a variety of articles, particularly, daily sundries such as clothes, for example, a garment, bags, shoes and the like, the slide fastener attached thereto is also treated as one factor of a design and it is needed to increase an overall outward appearance quality of the article including the slide fastener. Also, in the related art, the slide fastener is in general linearly attached to the article, which is a fastener-attached member. However, the slide fastener is recently attached with being bent to the fastener-attached member from standpoints of convenience and design of the article.

However, according to the slide fasteners of the related art disclosed in Patent Documents 1 to 3, the tape main body portion of the fastener tape having the continuous fastener elements fixed thereto is sewn and fixed to the opening and closing part of an article (for example, clothes) becoming the fastener-attached member. Therefore, in order to smoothly sew the slide fastener and the fastener-attached member by the sewing machine, it is necessary to secure, as a seam allowance, a width size of the tape main body portion of the fastener tape exposed at a more outer side than the fastener element in a tape width direction.

Also, since the fastener tape to be used for the slide fastener is woven or knitted, it is configured to be thin (a thickness size thereof is small) in a tape thickness direction. Together this, in order to secure the width size of the tape main body portion of the fastener tape as the seal allowance to thus smoothly perform the sewing operation by the sewing machine, as described above, and to stably sew the fastener tape to a variety of fastener-attached members, the tape main body portion of the fastener tape is formed to be wide in the tape width direction.

Like this, according to the slide fasteners of the related art, the fastener tape is formed to be thin in the thickness direction and to be wide in the width direction. Therefore, when linearly attaching the slide fastener to the fastener-attached member, it is possible to neatly sew the slide fastener to the seats. However, when attaching the slide fastener to the fastener-attached member with being bent such as a curved shape, the tape main body portion contacting an outer periphery of the slide fastener is partially largely uplifted or sunk, and a tape extension portion (tape extension portion curved into a recess shape) contacting an inner periphery of the slide fastener is formed with a large undulated wrinkle.

As described above, when the tape extension portion is largely uplifted, it is not possible to correctly press the fastener tape with a sewing machine foot of the sewing machine. Also, when the large undulated wrinkle is caused in the tape extension portion, it is difficult to sew the slide fastener and the fastener-attached member by the sewing machine because the fastener tape is partially overlapped.

Also in the article (article with the slide fastener affixed thereto) to which the slide fastener is sewn, when the large uplift or sinking or the undulated wrinkle is caused in the fastener tape, the appearance (outward appearance quality) of the article with the slide fastener affixed thereto is deteriorated. Further, when sliding the slider along the element rows, the fastener tape is likely to sliding-contact the slider. Thereby, the sliding resistance of the slider is increased, so that the slidability of the slider is degraded.

It is therefore an object of the present invention to provide a stringer without fastener tape capable of saving a weight of a slide fastener, reducing the cost and being attached to a fastener-attached member in a good-looking appearance manner even at a state the stringer is bent such as a curved shape, and an article with the slide fastener affixed thereto, which is configured using the stringer without fastener tape.

Means for Solving Problems

In order to achieve the above object, according to the present invention, there is provided a stringer without fastener tape including a plurality of continuous fastener elements formed from a mono filament, and a narrow element fixing member to which the fastener elements are sewn in series by sewing threads, wherein each of the fastener elements has an engaging head, upper and lower leg portions extending from the engaging head in a fastener width direction, and a connection portion extending from the upper leg portion or the lower leg portion and connected to an adjacent fastener element in a fastener length direction, wherein the element fixing member is inserted between the upper and lower leg portions of the fastener elements along the fastener length direction, and wherein the sewing threads come in contact with and bridge over the upper leg portions and lower leg portions of the respective fastener elements, pierce the element fixing member between the fastener elements adjacent to each other in the fastener length direction and seam the fastener elements and the element fixing member.

In the stringer without fastener tape of the present invention, the element fixing member preferably has a size in the fastener width direction twice or more as large as a size in a fastener thickness direction at an unloaded state.

In the stringer without fastener tape of the present invention, the element fixing member is preferably a tape member having a woven structure. Also, the element fixing member may be a tape member having a warp knitted structure in which a chain stitch thread is arranged at each wale, a tape member made of non-woven fabric or a film member made of a synthetic resin.

Also, the upper and lower leg portions are preferably sewn to the element fixing member by a double chain stitch of the sewing threads.

According to the present invention, there is provided an article with a slide fastener affixed thereto in which the stringer without fastener tape having the above configuration is attached to an opening and closing part of a fastener-attached member and a slider is slidably attached to an element row formed by the fastener elements.

Advantageous Effects of Invention

The stringer without fastener tape provided according to the present invention includes the continuous fastener elements formed from the mono filament and having a coil or zigzag shape, and the narrow element fixing member. The narrow element fixing member is inserted between the upper and lower leg portions of the fastener elements along the fastener length direction, and wherein the continuous fastener elements are sewn in series to the narrow element fixing member arranged between the upper and lower leg portions by the sewing thread.

Here, the fastener tape is a tape member configured to come in contact with outer surfaces (surfaces opposite to the opposing surfaces of the upper and lower leg portions) of the upper or lower leg portions of the fastener elements to fix the upper or lower leg portions thereto, and is a member different from the element fixing member of the present invention. That is, the fastener stringer of the present invention is not provided with the so-called fastener tape for fixing the upper or lower leg portions, which is to be arranged at an outer side of the upper or lower leg portions, and is configured as a stringer without fastener tape having a new structure different from the general fastener stringer of the related art.

Also, in the present invention, the sewing threads come in contact with and bridge over the upper leg portions and lower leg portions of the respective fastener elements, pierces the element fixing member between the fastener elements adjacent to each other in the fastener length direction and sews and fixes the continuous fastener elements to the element fixing member. In this case, the element fixing member preferably has a less stretchable structure where it is not easily stretchable in the fastener length direction, like a core string of the related art, but difficult to be stretched in the fastener length direction.

In the fastener stringer in which the fastener tape is not used (the stringer without fastener tape) according to the present invention, the fastener elements are sewn to the element fixing member (particularly, the less stretchable element fixing member) inserted between the upper and lower leg portions. For this reason, even when the fastener tape of the related art is not used as the constitutional member of the fastener stringer, it is possible to stably keep an attachment pitch of the fastener elements by the element fixing member.

Therefore, when an article with the slide fastener affixed thereto is configured by attaching the stringer without fastener tape to a fastener-attached member, it is possible to reduce a weight of the article with the slide fastener affixed thereto and to save the cost. Also, it is possible to use the fastener tape for a purpose (for example a decorative purpose) different from the functions of the related art.

Further, according to the present invention, since it is possible to configure the fastener stringer or slide fastener without using the fastener tape, it is possible to stably attach the stringer without fastener tape to the fastener-attached member with being bent into a curved shape, for example. Also, in this case, the uplift or sinking of the fastener tape and the undulated wrinkle, which are problematic in the slide fastener of the related art, are not caused. Therefore, it is possible to improve the appearance (outward appearance quality) of the article with the slide fastener affixed thereto.

In the stringer without fastener tape of the present invention, the element fixing member has a size in the fastener width direction twice or more as large as a size in a fastener thickness direction at an unloaded state. Thereby, it is possible to easily provide the structure where the element fixing member is difficult to be stretched in the fastener length direction.

In the stringer without fastener tape of the present invention, as the element fixing member, a tape member having a woven structure, a tape member having a warp knitted structure in which a chain stitch thread is arranged at each wale, a tape member made of non-woven fabric or a film member made of a synthetic resin is used. The tape member or film member is used as the element fixing member, so that it is possible to make it difficult for the element fixing member to be stretched in the fastener length direction by the simple structure. Thereby, it is possible to stably keep the attachment pitch of the fastener elements in the stringer without fastener tape.

Also, since the tape member or film member has a flat sectional shape of which a size in the thickness direction is small and a size in the width direction is large, it is possible to easily insert the tape member or film member between the upper and lower leg portions of the fastener elements. Also, for example, when sewing the upper and lower leg portions of the fastener elements to the tape member or film member by using a sewing machine, for example, it is possible to enable a sewing machine needle to stably pierce the tape member or film member, thereby smoothly performing the sewing operation.

In the stringer without fastener tape of the present invention, the upper and lower leg portions of the fastener elements are sewn to the element fixing member by the double chain stitch of the sewing thread. Thereby, when sewing the fastener elements to the element fixing member, since it is possible to effectively sew and fix the upper and lower leg portions of the fastener elements to the element fixing member, it is possible to improve the productivity. Also, the upper and lower leg portions are securely fixed to the element fixing member by the double chain stitch of the sewing thread, and even when the sewing thread is cut, it is possible to prevent the sewing thread from fraying.

According to the article with the slide fastener affixed thereto of the present invention, the stringer without fastener tape having the above configuration is attached to the opening and closing part of the fastener-attached member and the slider is slidably attached to the element row formed by the fastener elements.

According to the article with the slide fastener affixed thereto, since the fastener elements are sewn to the element fixing member, as described above, it is possible to stably keep the attachment pitch of the fastener elements without using the fastener tape as the constitutional member of the slide fastener.

That is, according to the present invention, since it is possible to stably keep the attachment pitch of the fastener elements at a predetermined interval and to omit the fastener tape, which is necessarily provided for the slide fastener of the related art, it is possible to reduce the weight of the article with the slide fastener affixed thereto and to save the cost.

Further, when the article with the slide fastener affixed thereto is configured without using the fastener tape, it is possible to stably attach the stringer without fastener tape to the fastener-attached member with being bent into a curved shape, for example. Also, in this case, the uplift or sinking of the fastener tape and the undulated wrinkle, which are problematic in the slide fastener of the related art, are not caused. Therefore, it is possible to improve the appearance (outward appearance quality) of the article with the slide fastener affixed thereto.

EMBODIMENTS OF INVENTION

Hereinafter, preferred illustrative embodiments of the present invention will be described in detail with reference to the drawings. In the meantime, the present invention is not limited to the illustrative embodiments and can be variously changed inasmuch as the changes have substantially the same configuration as the present invention and accomplish the same operational effects.

For example, in the respective illustrative embodiments, continuous fastener elements of a slide fastener are configured by forming a mono filament into a coil shape. However, the present invention is not limited thereto. For example, the continuous fastener elements may be configured by forming the mono filament into a zigzag shape.

Illustrative Embodiment

Figure 1:
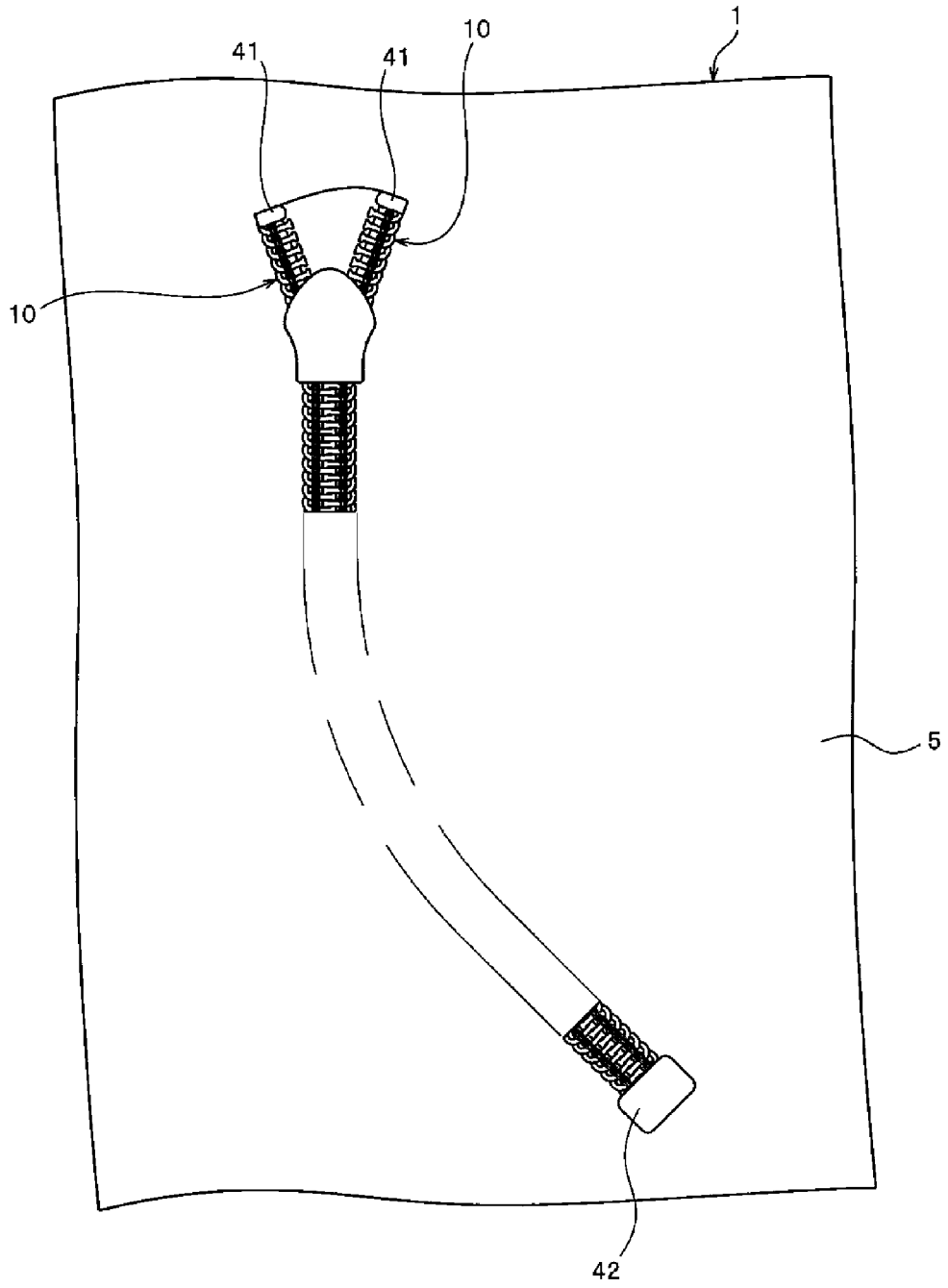
FIG. 1 is an enlarged view illustrating a main part of an article with a slide fastener affixed thereto according to an illustrative embodiment of the present invention, which is seen from a back surface.
Figure 2:
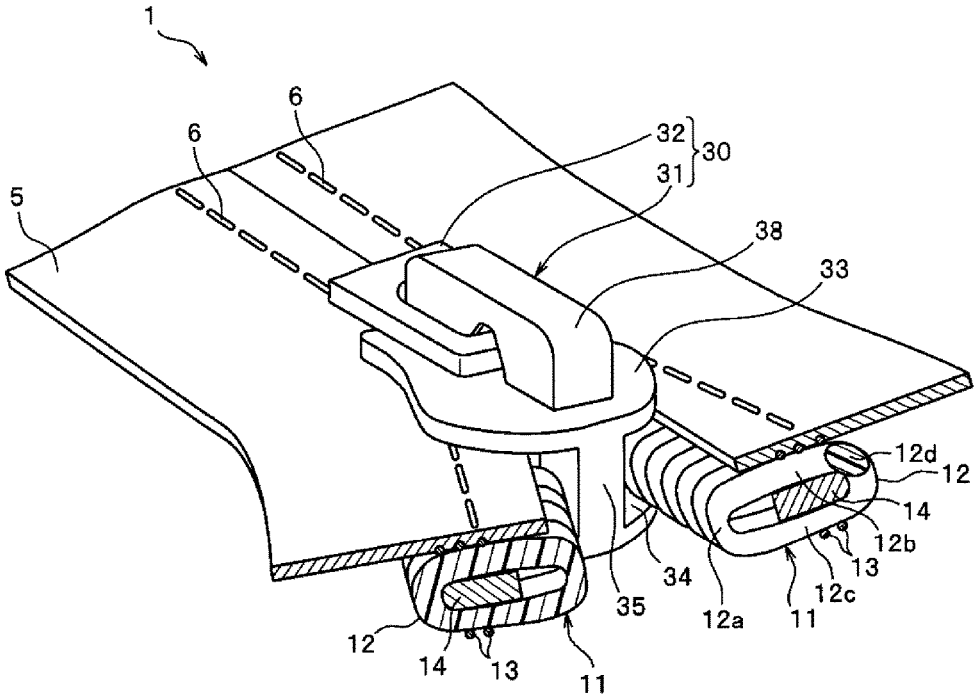
FIG. 2 is an enlarged perspective view of the main part of the article with the slide fastener affixed thereto.
Figure 3:
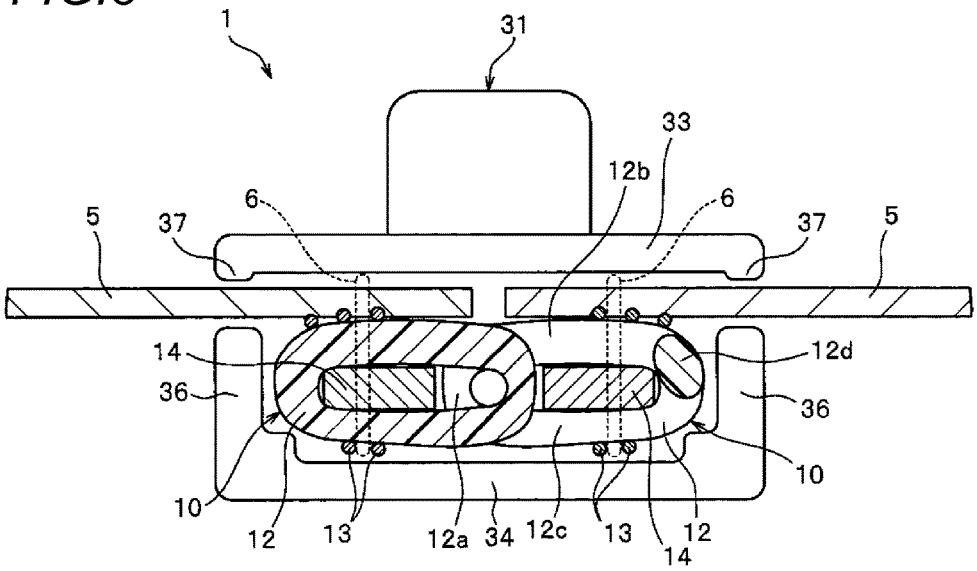
FIG. 3 is a sectional view of the article with the slide fastener affixed thereto.
Figure 4:
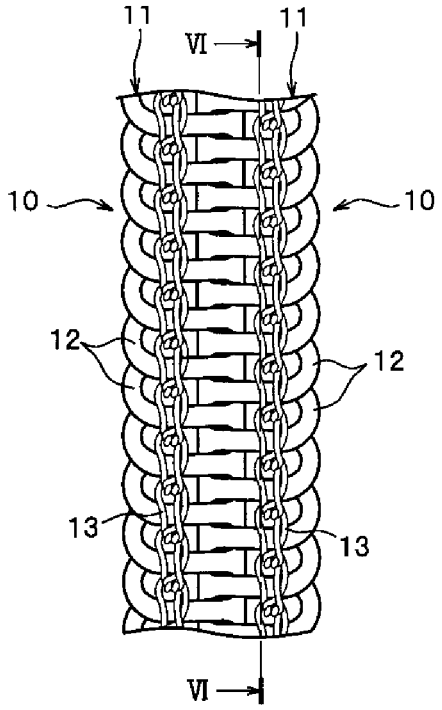
FIG. 4 is a plan view of a stringer without fastener tape, which is to be used for the article with the slide fastener affixed thereto.
Figure 5:
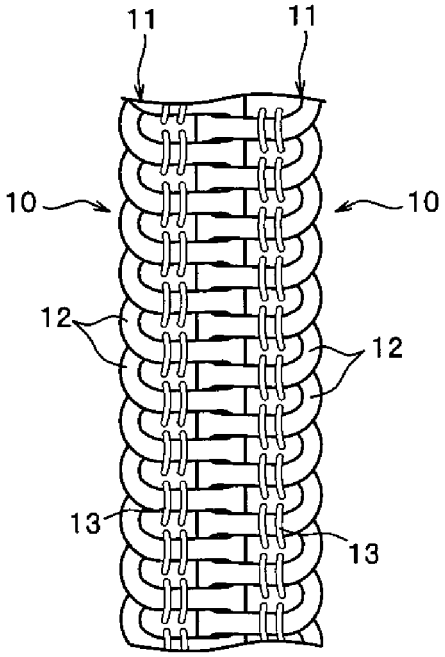
FIG. 5 is a bottom view of the stringer without fastener tape.

FIG. 1 is an enlarged view illustrating a main part of an article with a slide fastener affixed thereto according to an illustrative embodiment, which is seen from a back surface. FIG. 2 is an enlarged perspective view of the main part of the article with the slide fastener affixed thereto. FIG. 3 is a sectional view of the article with the slide fastener affixed thereto. FIGS. 4 and 5 are a plan view and a bottom view of a stringer without fastener tape, which is to be used for the article with the slide fastener affixed thereto.

Meanwhile, in the description about the slide fastener, a front and rear direction indicates a length direction of the slide fastener or a length direction of a tape member. In particular, a direction along which the slider slides to engage the element rows of the slide fastener is referred to as front, and a direction along which the slider slides to disengage the element rows is referred to as rear.

Also, a right and left direction indicates a fastener width direction of the slide fastener, and for example, is a direction parallel with a tape surface of the tape member of the slide fastener and orthogonal to a tape length direction. Further, an upward and downward direction indicates a direction orthogonal to the front and rear direction and the right and left direction, and for example, is a tape thickness direction orthogonal to the tape surface of the tape member. In particular, a direction of a side of the fastener element on which a pull tap of the slider is arranged is referred to as an upward direction and an opposite direction thereto is referred to as a downward direction.

An article 1 with a slide fastener affixed thereto according to the illustrative embodiment is a garment (clothes). The slide fastener is configured at an opening and closing part provided at a placket of a front body of the garment 1, an opening and closing part (opening peripheral edge portion) of pocket parts provided in chest and abdominal regions of the front body, and the like. That is, in the illustrative embodiment, the fastener-attached member with respect to the slide fastener becomes a cloth (also referred to as garment cloth) 5 of the garment 1.

In this case, the slide fastener of the illustrative embodiment is attached to the garment 1 in a so-called reverse use aspect where element rows 11 of fastener stringers 10 are arranged on a back surface-side (inner surface-side) of the cloth 5 of the garment 1 so that the slide fastener is not seen well from the outer surface-side of the garment 1. Also, for example, as shown in FIG. 2, the right and left clothes 5 are arranged to face each other at each opening and closing part of the garment 1 so that the clothes can be connected and disconnected each other by the opening and closing operation of the slide fastener.

Meanwhile, in the present invention, the article to which the slide fastener is to be attached is not limited to the garment (clothes) and includes daily sundries such as shoes and bags, an article such as industrial materials, and various seats of a vehicle, a train, an airplane and the like.

As shown in FIGS. 2 and 3, the slide fastener provided for the garment 1 of the illustrative embodiment includes a pair of right and left fastener stringers (fastener stringers without fastener tape) 10 each of which has an element row 11, a slider 30 arranged to be slidable along the element rows 11, first end stops 41 arranged in the vicinity of front ends of the element rows 11 and configured to prevent the slider 30 from separating, and a second end stop 42 arranged to bridge between the right and left fastener stringers 10 in the vicinity of rear ends of the element rows 11.

Each of the right and left fastener stringers 10 has fastener elements 12 continuing in a coil shape, and a narrow tape member 14 to which the fastener elements 12 are sewn and fixed by a first sewing thread 13. Each fastener stringer 10 is configured as a stringer 10 without fastener tape in which a fastener tape is not arranged not only at an outer side of upper leg portions 12*b* of the fastener elements 12 but also at an outer side of lower leg portions 12*c*.

The fastener element 12 is formed by molding a mono filament of a thermoplastic resin such as polyamide and polyester into a coil shape, and has an engaging head 12*a* having a portion bulging in the front and rear direction, an upper leg portion 12*b* and a lower leg portion 12*c* extending from the engaging head 12*a* in the width direction and a connection portion 12*d* configured to connect the upper leg portion 12*b* (or lower leg portion 12*c*) of the continuous fastener element 12 and the lower leg portion 12*c* (or upper leg portion 12*b*) of the other adjacent fastener element 12 in the fastener length direction.

Meanwhile, in the present invention, as the fastener element 12, instead of the fastener element 12 formed by winding the mono filament into a coil shape, a fastener element formed by bending the mono filament into a zigzag shape may also be used, as described above.

Figure 7:
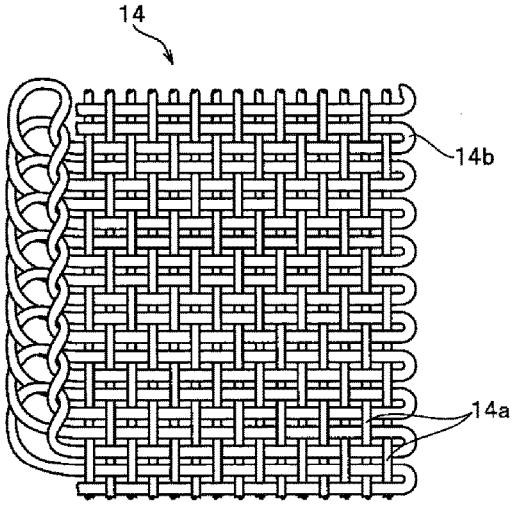
FIG. 7 is a pictorial view illustrating a woven structure of a woven tape member that is to be used as an element fixing member.

As shown in FIG. 7, the narrow tape member 14 becoming the fixing member configured to fix the fastener elements 12 has a plain woven structure woven into a single layer by a plurality of warps 14*a* and a weft 14*b* of which two single yarns are configured as one set with being regularly arranged.

The tape member (woven tape member) 14 woven into the plain woven structure has a flat sectional shape of which a size in the thickness direction is small and a size in the width direction is large, and is woven by the warps 14*a* and weft 14*b* to thus have a less stretchable structure where the stretching in the fastener length direction is restrained. In the meantime, one side edge portion of the woven tape member 14 is formed with an extension portion formed by sequentially hooking the weft 14*b* of a next position and connecting a loop folding-back end.

Figure 6:
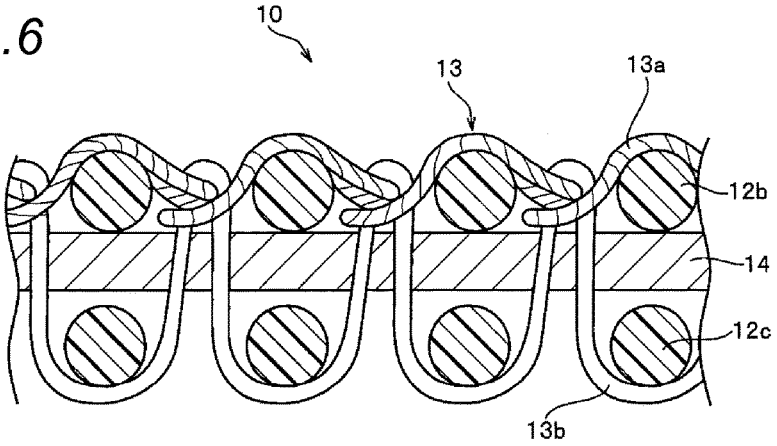
FIG. 6 is a sectional view of the stringer without fastener tape, which is taken along a line VI-VI of FIG. 4.

As shown in FIGS. 4 to 6, at a state where the woven tape member 14 is inserted between the upper and lower leg portions 12*b*, 12*c* of the fastener elements 12 in the fastener length direction, the upper leg portions 12*b* and the lower leg portions 12*c* are fixed to front and back surfaces of the woven tape member 14 by the first sewing thread 13. The first sewing thread 13 is to attach the fastener elements 12 to the woven tape member 14 (fixing member) and is also referred to as a first fixing means.

Particularly, in the illustrative embodiment, at the state where the woven tape member 14 is inserted into an internal space formed between the upper and lower leg portions 12*b*, 12*c* of the fastener elements 12, the woven tape member 14 and the fastener elements 12 are sewn in series by a double chain stitch of the first sewing thread 13 by using a sewing machine for element sewing. Also, the fastener elements 12 continuing in a coil shape are sewn and fixed to the woven tape member 14 over the entirety in the fastener length direction.

In the illustrative embodiment, the woven tape member 14 has the flat sectional shape, as described above, so that it is possible to easily insert the woven tape member 14 between the upper and lower leg portions 12*b*, 12*c* of the fastener elements 12. Also, for example, as described later, when sewing the upper and lower leg portions 12*b*, 12*c* to the woven tape member 14 by using the sewing machine, it is possible to enable a sewing machine needle to stably pierce the woven tape member 14, thereby smoothly performing the sewing operation.

In this case, a looper thread 13*a* of the first sewing thread 13 comes in direct contact with and bridge over the upper leg portions 12*b* of the fastener elements 12 on a front surface of the woven tape member 14, and a needle thread 13*b* of the first sewing thread 13 comes in direct contact with and bridge over the lower leg portions 12*c* of the fastener elements 12 on a back surface of the woven tape member 14, pierces the woven tape member 14 between the fastener elements 12 adjacent to each other and interlaces with the looper thread 13*a* passing to the front surface of the woven tape member 14. Thereby, a seam is formed between the respective fastener elements 12 and a first sewing portion by the double chain stitch of the first sewing thread 13 is formed to appear from the front surface and back surface of the element row 11.

In this way, the fastener elements 12 are fixed to the woven tape member 14, which is difficult to be stretched in the fastener length direction, by the double chain stitch of the first sewing thread 13, so that the woven tape member 14 can maintain, as the element fixing member, the shape of the fastener elements 12 and keep an attachment pitch (in other words, an interval between the engaging heads 12*a*) of the fastener elements 12 to be constant.

Also, since the first sewing thread 13 pierces the woven tape member 14 to keep the fastener elements 12, a piercing position of the first sewing thread 13 with respect to the woven tape member 14 is difficult to deviate, so that it is possible to securely fix and support the upper and lower leg portions 12*b*, 12*c* of the fastener elements 12 at predetermined positions of the woven tape member 14. For this reason, it is possible to prevent the upper and lower leg portions 12*b*, 12*c* from moving relative to the woven tape member 14.

Further, the double chain stitch is preferably adopted as the stitch form of the first sewing thread 13 because the seam strength is high and the flexibility is improved. Also, even though the first sewing thread 13 cut, it is possible to make it difficult for the first sewing thread 13 to fray. Further, the woven tape member 14 and the fastener elements 12 are sewn to each other by the double chain stitch, so that it is possible to produce the stringer 10 without fastener tape in high productivity. Meanwhile, in the present invention, as the stitch form of the first sewing thread 13, the other form such as lock stitch may also be adopted, instead of the double chain stitch.

Also, according to the fastener stringer 10 of the illustrative embodiment configured as described above, the fastener tape, which is necessarily provided for the fastener stringer 10 of the related art, is omitted. Therefore, it is possible to save the weight and the producing cost, as compared to the fastener stringer of the related art.

Further, the fastener elements 12 are sewn to the woven tape member 14 having the structure wherein the tape member is difficult to be stretched in the fastener length direction. Therefore, even when the fastener tape is omitted, it is possible to stably keep the attachment positions of the fastener elements 12 by the woven tape member 14. Also, even when the stringer 10 without fastener tape is bent into a curved shape, for example, the uplift or sinking or the undulated wrinkle is not caused, which occurs in the fastener stringer of the related art.

Figure 8:
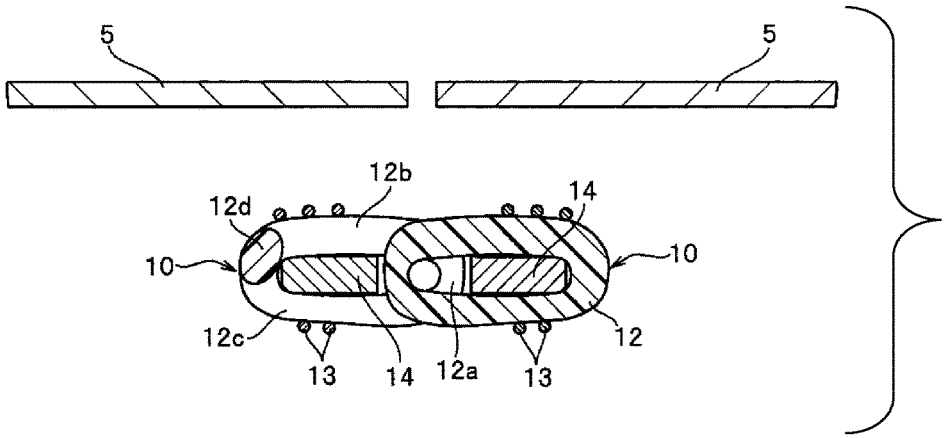
FIG. 8 is a sectional view illustrating a state before the stringer without fastener tape and a fastener-attached member are sewn each other.
Figure 9:
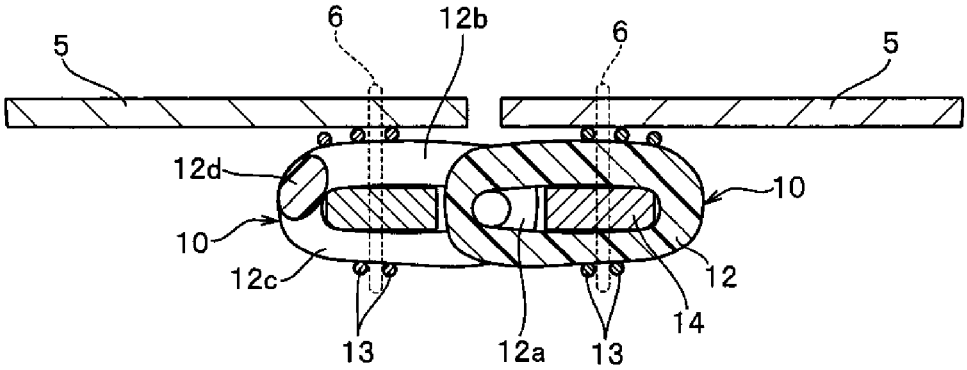
FIG. 9 is a sectional view illustrating a state where the stringer without fastener tape is sewn to the fastener-attached member.

As shown in FIGS. 8 and 9, the stringer 10 without fastener tape is sewn and fixed to the cloth 5 by a lock stitch of a second sewing thread 6 with the sewing machine for sewing a slide fastener at a state where the stringer is positioned with respect to the cloth 5 of the garment 1, which is the fastener-attached member. In this case, the fastener elements 12 and the woven tape member 14 are sewn to the cloth 5 over the entirety in the fastener length direction. Also, the second sewing thread 6 is to attach the fastener stringer 10 to the cloth 5 and is also referred to as a second fixing means.

Particularly, in the illustrative embodiment, the second sewing thread 6 bridges over the upper and lower leg portions 12*b*, 12*c* of the fastener elements 12 and pierces the woven tape member 14 and the cloth 5 between the fastener elements 12 adjacent to each other, so that the stringer 10 without fastener tape is sewn to the cloth 5.

In this case, the sewing by the lock stitch of the second sewing thread 6 is performed using a ball point needle as the sewing machine needle. The ball point needle is a needle having a spherical tip and a diameter of the tip is preferably 0.2 mm to 0.6 mm.

Like this, the ball point needle is used, so that even when the sewing machine needle collides with the fastener element 12 upon the sewing, the ball point needle can pierce the woven tape member 14 and cloth 5 while a position of the ball point needle relatively deviates in the front and rear direction along the fastener element 12. Therefore, it is possible to avoid the damage of the fastener elements 12, the damage and bending of the sewing machine needle and the like and to smoothly and stably perform the sewing process.

Further, the lock stitch is adopted as the stitch form of the second sewing thread 6, so that the seam of the second sewing thread 6 is difficult to fray and has excellent strength. Also, even when the ball point needle collides with the fastener element 12 upon the sewing and thus the position of the ball point needle (in other words, a position at which the needles pierces the woven tape member 14 and the cloth 5) deviates, it is possible to smoothly and stably seam the stringer 10 without fastener tape and the cloth 5.

In the meantime, in case of performing the sewing by the second sewing thread 6, when the ball point needle collides with the fastener element 12, since the fastener element 12 is appropriately fixed to the woven tape member 14 of the stringer 10 without fastener tape of the illustrative embodiment, as described above, the fastener element 12 is permitted to slightly move so as to avoid the ball point needle and the pitch of the fastener elements 12 kept by the woven tape member 14 is prevented from being non-uniform.

Also, in the illustrative embodiment, the second sewing portion (particularly, a portion of the second sewing thread 6 appearing from the element row 11) by the lock stitch of the second sewing thread 6 is arranged to overlap within a formation range of the first sewing portion by the double chain stitch of the first sewing thread 13, in the fastener width direction. Here, the description 'the second sewing portion is within the formation range of the first sewing portion' means that the second sewing portion to be formed on the surface of the element row 11 (an outer surface of the lower leg portion 12*c* of the fastener element 12) is arranged in a range of the first sewing portion to be formed on the surface of the element row 11 (an outer surface of the lower leg portion 12*c* of the fastener element 12), in the tape width direction.

In the meantime, the second sewing thread 6 forming the second sewing portion on the element row 11 (particularly, an outer surface of the lower leg portion 12*c* of the fastener element 12) passes between the lower leg portions 12*c* of the adjacent fastener elements 12, pierces the woven tape member 14, and further passes between the upper leg portions 12*b* of the adjacent fastener elements 12 and pierces the cloth 5. In this case, a part of the first sewing thread 13 is positioned between the second sewing thread 6 and the outer surface of the lower leg portion 12*c* of the fastener element 12.

The fastener elements 12, the woven tape member 14 and the cloth 5 are sewn each other and fixed so that they are positioned between the second sewing portion, which is a part of the second sewing thread 6 on the element row 11, and a part of the second sewing thread 6 appearing from the surface of the cloth 5.

As described above, the second sewing portion of the second sewing thread 6 is formed to overlap within the range of the first sewing portion of the first sewing thread 13, so that the second sewing portion is under screen of the first sewing portion and thus is not seen well. Therefore, it is possible to improve the appearance of the garment 1 to which the fastener stringer 10 is attached.

Also, since the second sewing portion is formed on the surface of the fastener element 12 together with the first sewing portion at a state where the fastener stringers 10 is fixed to the cloth 5, both the first sewing portion and the second sewing portion can bear the wear due to the sliding of the slider 30 and the wear/collision due to the external factors. For this reason, as compared to a configuration where the second sewing portion is spaced from the first sewing portion, it is possible to reduce the thread breakages of the first sewing thread 13 and second sewing thread 6.

Further, the second sewing portion is arranged to overlap within the range of the first sewing portion, so that it is possible to sew the fastener stringers 10 and the cloth 5 in the vicinity of the opposing side edges of the cloth 5. Thereby, it is possible to suppress the side edge portion of the cloth 5 within a more inner range than the second sewing portion in the fastener width direction from being bent (turned up). For this reason, when engaging the right and left fastener elements 12, it is possible to bring the opposing side edges of the right and left clothes 5 close to (or into contact with) each other, thereby making it difficult for the element rows 11 to be seen from between the right and left clothes 5 (or making it impossible for the element rows 11 to be seen from between the right and left clothes 5).

Also, in this way, even when the second sewing portion by the second sewing thread 6 is formed to overlap within the range of the first sewing portion by the first sewing thread 13, the ball point needle is used as the sewing machine needle, as described above, so that it is possible to perform the sewing while enabling a tip of the ball point needle to divide the first sewing thread 13 and to pass therebetween. Therefore, upon the sewing of the second sewing thread 6, it is possible make it difficult for the first sewing thread 13 to be cut. Meanwhile, in the present invention, a stitch form other than the lock stitch can also be adopted as the stitch form of the second sewing thread 6.

After sewing the pair of stringers 10 without fastener tape to the cloth 5 of the garment 1 by the lock stitch of the second sewing thread 6, as described above, the slider 30 is slidably attached to the element rows 11 of both the fastener stringers 10. After that, the first end stops 41 and the second end stop 42 are formed to be close to the front and rear ends of the element rows 11.

In the illustrative embodiment, as shown in FIGS. 2 and 3, for example, the slider 30 has a slider body 31 and a pull tap 32 having an attachment shaft portion at one end portion. Also, the slider body 31 has an upper blade 33, a lower blade 34 spaced from and arranged in parallel with the upper blade 33, a guide post 35 configured to connect front end portions (shoulder mouth side end portions) of the upper and lower blades 33, 34, lower flange portions 36 provided to vertically extend from right and left side edge portions of the lower blade 34 towards the upper blade 33, ridge portions 37 arranged at right and left side edge portions of the upper blade 33, and a pull tap attachment portion 38 arranged on an upper surface of the upper blade 33.

A front end portion of the slider body 31 is formed with right and left shoulder mouths with the guide post 35 being interposed therebetween, and a rear end portion of the slider body 31 is formed with a rear mouth. Also, a substantially Y-shaped element guide path configured to communicate the right and left shoulder mouths and the rear mouth each other and to have such a size that the fastener elements 12 and the cloth 5 can be inserted therein is formed between the upper and lower blades 33, 34.

In the illustrative embodiment, the first end stops 41 are attached to the cloth 5 in the vicinity of the right and left element rows 11 so that the slider 30 is not separated from the front ends-side of the element rows 11. Also, the second end stop 42 is attached to the cloth 5 to bridge between the right and left element rows 11 in the vicinity of the rear ends of the right and left element rows 11 so that the slider 30 is not separated from the rear ends-side of the element rows 11.

Meanwhile, in the present invention, the means for attaching the first and second end stops 41, 42 to the cloth 5 is not particularly limited. For example, the first and second end stops 41, 42 may be fixed to the cloth 5 by bonding or welding. Also, the first and second end stops 41, 42 made of metal may be plastically deformed by crimping processing and the like and fixed to the cloth 5.

Also, in the present invention, a separable bottom end stop may be provided in the vicinity of the rear ends of the element rows 11, instead of the second end stop 42. Further, for example, the rear end portions of the element rows 11 may be pressed and squashed to widen the widths or the sewing may be performed to traverse the rear end portions of the element rows 11 so that the second end stop 42 is formed.

Meanwhile, in the illustrative embodiment, after sewing the pair of stringers 10 without fastener tape to the cloth 5, the slider 30 is attached to the element rows 11 of the stringers and the first end stops 41 and the second end stop 42 are attached to the cloth 5.

However, in the present invention, after attaching the slider 30 to the element rows 11 of the pair of stringers 10 without fastener tape, the stringers may be sewn to the cloth 5 by the lock stitch of the second sewing thread 6. In the meantime, considering the sewing efficiency and productivity by the second sewing thread 6, it is preferably to attach the slider 30, the first end stops 41 and the second end stop 42 after sewing the stringers 10 without fastener tape to the cloth 5.

In this way, according to the garment 1 with the slide fastener affixed thereto of the illustrative embodiment, since it is possible to configure the slide fastener without using a fastener tape, it is possible to reduce the weight of the slide fastener and to save the cost.

Further, for example, when the stringers 10 without fastener tape are attached with being bent such as a curved shape to the opening and closing part of the pocket part provided at the chest region or abdominal region of the garment 1, the uplift or sinking of the fastener tape and the undulated wrinkle, which are problematic in the slide fastener of the related art, are not caused. Therefore, it is possible to improve the appearance (outward appearance quality) of the garment 1.

Also, the sewing machine having the ball point needle is used to attach the stringers 10 without fastener tape, so that it is possible to easily and stably attach the stringers 10 without fastener tape to the cloth 5 of the garment 1. Therefore, it is possible to neatly finish the garment 1 by the relatively simple sewing operation.

Figure 10:
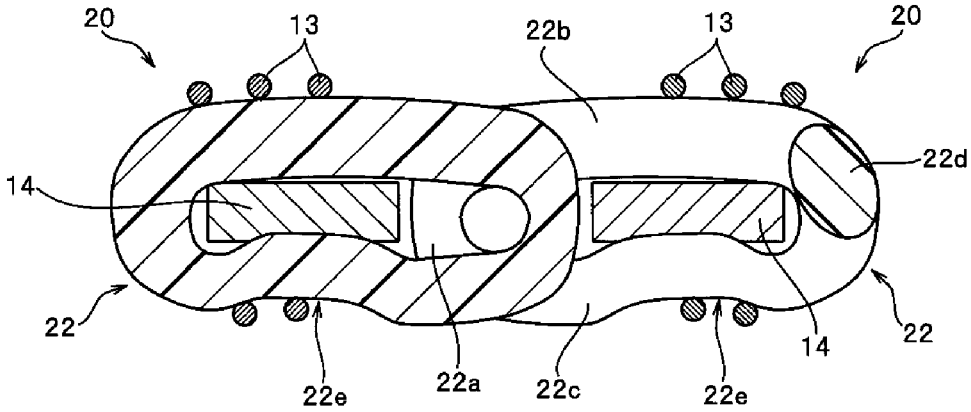
FIG. 10 is a sectional view illustrating a modified embodiment of the stringer without fastener tape.

Meanwhile, in the present invention, instead of the coil-shaped continuous fastener elements 12 as shown in FIGS. 2 and 3, coil-shaped continuous fastener elements 22 as shown in FIG. 10 may be used to configure stringers 20 without fastener tape.

A fastener element 22 to be used for the stringer 20 without fastener tape, which is shown in FIG. 10, is formed by molding the mono filament of a thermoplastic resin into a coil shape, and has an engaging head 22*a* having a portion bulging in the front and rear direction, an upper leg portion 22*b* and a lower leg portion 22*c* extending from the engaging head 22*a* in the width direction and a connection portion 22*d* configured to connect the upper leg portion 22*b* (or lower leg portion 22*c*) of the continuous fastener element 22 and the lower leg portion 22*c* (or upper leg portion 22*b*) of another adjacent fastener element 12 in the fastener length direction.

Also, the one leg portion (in this case, the lower leg portion 22*c*) of the non-contact side of the fastener element 22 to the cloth is deformed to be partially recessed towards the other leg portion (in this case, the upper leg portion 22*b*) of the contact-side to the cloth, so that an outer surface of the one leg portion (a lower surface of the lower leg portion 22*c*) is formed with a recessed portion 22*e* in which the first sewing thread 13 is arranged (accommodated).

The recessed portion 22*e* is provided on the lower surface of the lower leg portion 22*c*, and the first sewing thread 13 bridges over the recessed portion 22*e* to restrain and sew the upper and lower leg portions 22*b*, 22*c* to the woven tape member 14, so that the stringer 20 without fastener tape is attached to the cloth. Thereby, when the slider 30 is slid, the first sewing thread 13 is difficult to contact the slider 30, so that the first sewing thread 13 is not worn well.

Further, in this case, since the second sewing thread 6 sewing the stringer 20 without fastener tape to the cloth 5 is also arranged to bridge over the recessed portion 22*e* of the lower leg portion 22*c*, like the first sewing thread 13, the second sewing thread 6 is also difficult to contact the slider 30, so that the second sewing thread 6 is not worn well. Therefore, in the article to which the stringers 20 without fastener tape (FIG. 10) are attached, even when the slider 30 is repeatedly slid, the first sewing thread 13 and the second sewing thread 6 are difficult to be cut, so that it is possible to stably keep the functions of the slide fastener over a long time period.

Further, as described above, the lower leg portion 22*c* of the fastener element 22 is deformed to be partially recessed towards the upper leg portion 22*b*, so that the woven tape member 14 can be stably sandwiched between the upper and lower leg portions 22*b*, 22*c*. Thereby, the positions of the upper and lower leg portions 22*b*, 22*c* with respect to the woven tape member 14 are more difficult to deviate in the fastener length direction, so that it is possible to more stabilize the pitch of the fastener elements 22.

Figure 11:
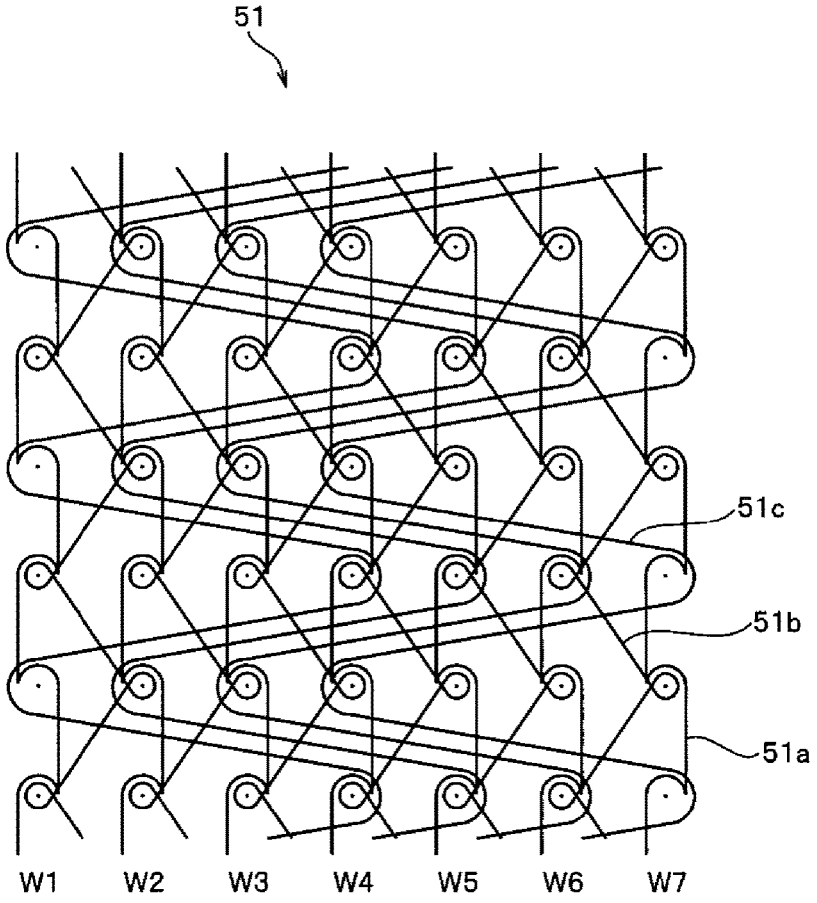
FIG. 11 is a structure view illustrating a warp knitted structure of a knitted tape member that is to be used as the element fixing member.

In the meantime, in the stringer 10 without fastener tape according to the illustrative embodiment, the narrow tape member 14 woven into the plain woven structure is used as the element fixing member to be arranged between the upper and lower leg portions 12*b*, 12*c* of the fastener elements 12. However, in the present invention, instead of the woven tape member 14, a narrow knitted tape member (warp knitted tape member) 51 as shown in FIG. 11, a narrow tape member made of non-woven fabric or a narrow film member 52 made of a synthetic resin and having a less stretchable property may also be used.

The element fixing member has a size in the fastener width direction (also referred to as tape width direction) at an unloaded state twice or more as large as a size in the tape thickness direction. More preferably, the size of the element fixing member in the fastener width direction is set to be 2.5 to 3.5 times as large as the size in the tape thickness direction.

Here, the unloaded state means a state where the element fixing member is taken out from the fastener elements 12 and the artificial external force such as tensile or compressive force is not applied to the element fixing member. The element fixing member is configured to have the size as described above, so that it is possible to provide a structure where the stretching in the fastener length direction is restrained.

Here, a core string of the related art, which is to be arranged between the upper and lower leg portions of the fastener elements, is a knitted cord obtained by knitting a plurality of bundled threads, in many cases. In the knitted cord of which the multiple threads are bundled, the multiple threads extend in the fastener length direction. However, each thread has a swelling (crimping) property in the fastener width direction and the fastener thickness direction. Therefore, the knitted cord is easily stretchable.

Since the core string of the related art has a circular sectional shape at an unloaded state, it can freely swell in both the fastener width direction and the fastener thickness direction. Therefore, the swelling is likely to occur, so that the core string can be easily stretched as the swelling occurs.

On the other hand, the swelling occurring in the core string of the related art is less caused in the element fixing member of the present invention. Therefore, the element fixing member has the less stretchable structure. Also, when the tensile force in the fastener length direction is applied to the element fixing member of the present invention, the sectional shape (particularly, the size in the tape thickness direction) is reduced, as compared to the unloaded state, and the reduction amount leads to an elongation in the fastener length direction. For this reason, the element fixing member is configured to have the small size in the tape thickness direction with respect to the size in the tape width direction, so that the sectional shape of the element fixing member is difficult to be reduced when the tensile force is applied. That is, the element fixing member has the less stretchable structure.

For example, the size of the element fixing member in the tape width direction is set to be twice or more as large as the size in the tape thickness direction. Thereby, for example, as compared to a configuration where the size of the element fixing member in the tape width direction is set to be equivalent to or 1.5 times as large as the size in the tape thickness direction, it is possible to make it difficult for the element fixing member to be stretched in the fastener length direction.

Also, for example, the warp knitted tape member 51 shown in FIG. 11 is a narrow band-shaped member consisting of a warp knitted structure and has a single structure of warp knitting. Also, an entire tape width of the warp knitted tape member 51 consists of a first wale W1 to a seventh wale W7. The knitted structure of the warp knitted tape member 51 consists of a chain stitch thread 51*a* (0-1/1-0) arranged at each wale, a tricot knitting thread 51*b* (1-0/1-2) and insertion wefts 51*c* (4-4/0-0) inserted into a zigzag shape over the four wales. In this case, the plurality of insertion wefts 51*c* are overall arranged over the first wale W1 to the seventh wale W7.

The warp knitted tape member 51 has a less stretchable structure where the stretching in the fastener length direction is suppressed by the chain stitch thread 51*a* arranged at each wale. For this reason, like the case where the woven tape member 14 is used as the element fixing member, it is possible to stably keep the attachment pitch of the fastener elements 12 by the warp knitted tape member 51 even when the fastener tape is omitted from the constitutional members of the fastener stringer.

Figure 12:
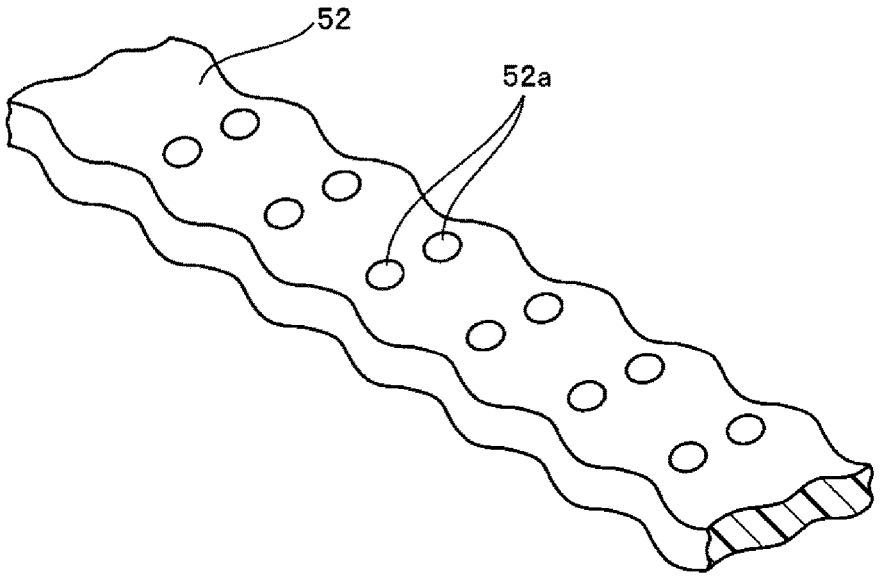
FIG. 12 is a perspective view illustrating a film member made of a synthetic resin, which is to be used as the element fixing member.
Figure 13:
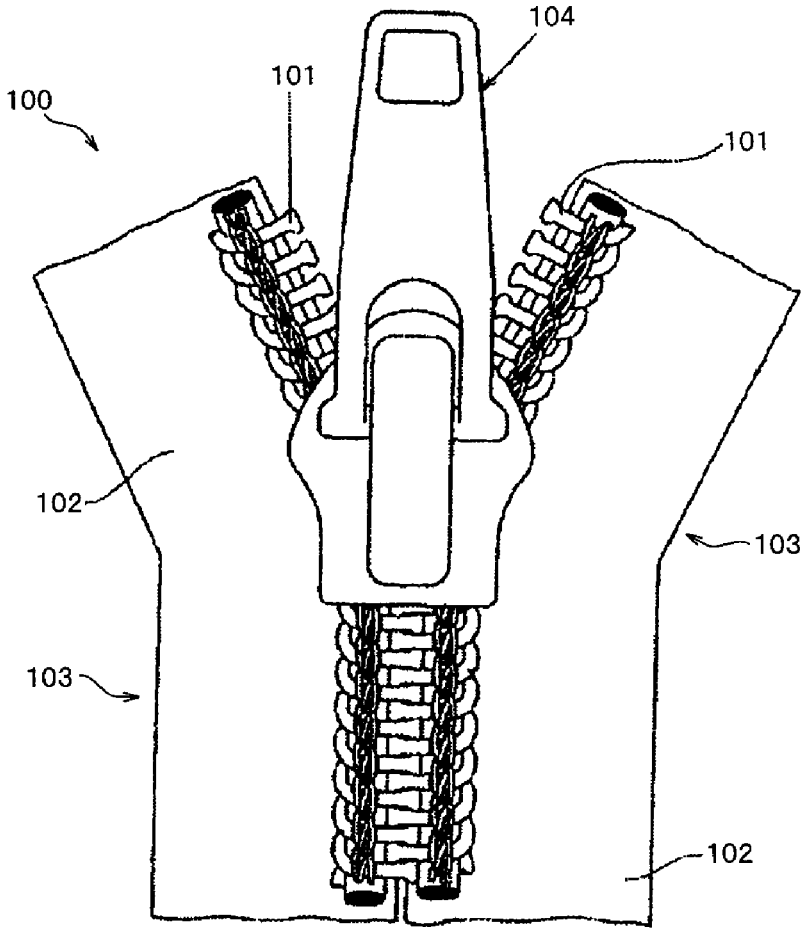
FIG. 13 is a plan view illustrating a slide fastener of the related art.
Figure 14:
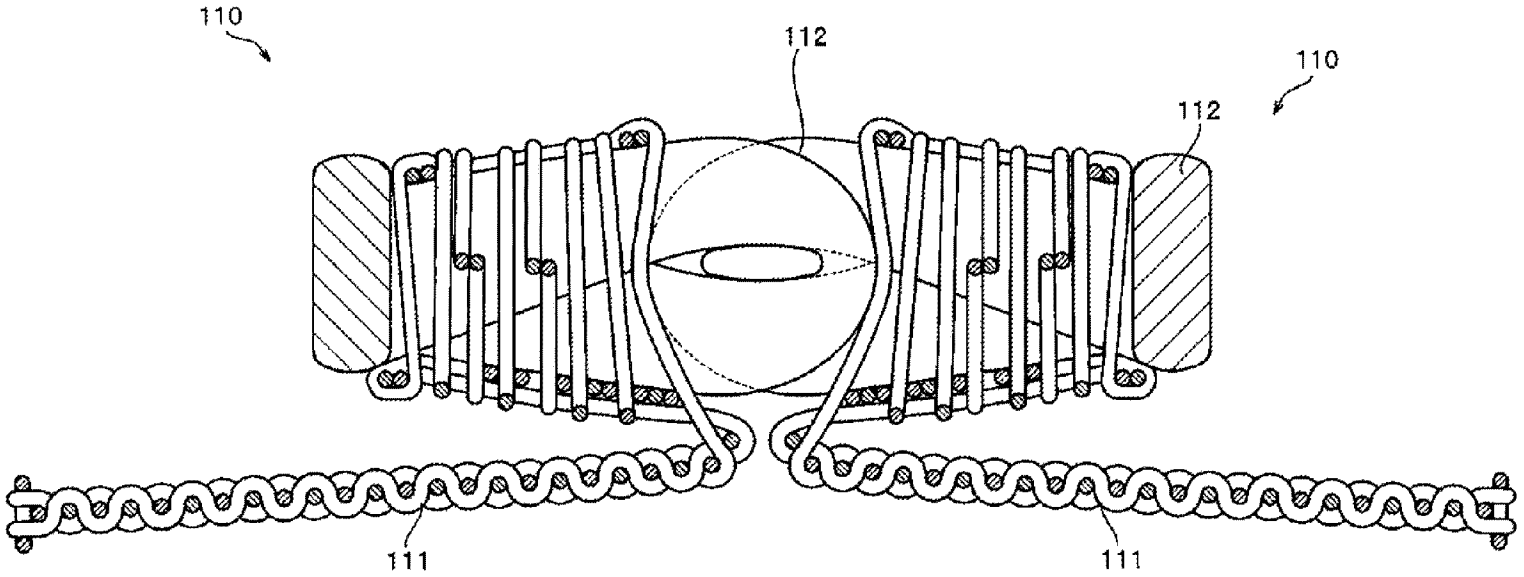
FIG. 14 is a sectional view illustrating a fastener chain for a slide fastener of the related art.
Figure 15:
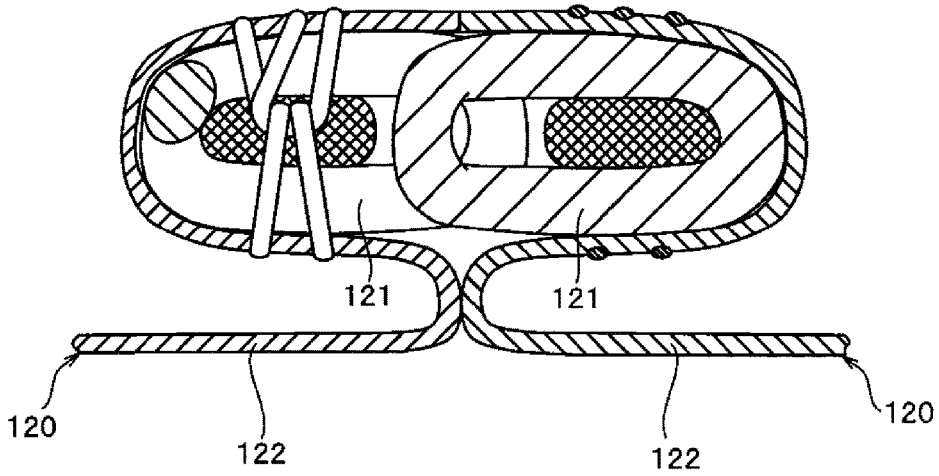
FIG. 15 is a sectional view illustrating a fastener chain for a slide fastener of the related art.

Also, even when the tape member made of the non-woven fabric or the film member 52 made of a synthetic resin shown in FIG. 12 is used as the element fixing member, it also has the less stretchable structure where the stretching in the fastener length direction is suppressed, like the woven tape member 14 and the warp knitted tape member 51 of FIG. 11. Therefore, it is possible to stably keep the attachment pitch of the fastener elements 12 even though the fastener tape is not used.

In the meantime, as the material of the film member 52, it is possible to select a less elastically deformable thermoplastic resin such as polyester and nylon, for example. Also, a film thickness of the film member 52 can be arbitrarily changed depending on the size of the fastener element 12. However, for example, the film thickness is preferably set to be 0.05 mm to 0.30 mm, particularly 0.15 mm to 0.20 mm so that the fastener stringer 10 has the appropriate stiffness and flexibility.

Also, in the present invention, the film member 52 made of a synthetic resin is straightly inserted between the upper and lower leg portions 12*b*, 12*c* of the fastener elements 12 along the fastener length direction. However, after that, when sewing the fastener elements 12 to the film member 52 by moving up and down the sewing machine needle of the sewing machine for element sewing, the sewing machine needle pierces the film member 52.

For this reason, as shown in FIG. 12, the film member 52 is formed with a plurality of through-holes 52*a* into which the sewing thread (needle thread) is inserted. Also, when the sewing machine needle pierces the film member 52 in the front and back direction, the film member 52 is applied with the stress from the sewing machine needle or the friction force, so that the film member 52 is deformed into a shape (serpentine shape) swelled in an undulated shape in the front and back direction with respect to the tape fastener length direction. Although the film member 52 has the shape (serpentine shape) swelled in the undulated shape as a whole, since it is straightly formed between the through-holes 52*a* in the fastener length direction, the film member has a structure where it is difficult to be stretched in the fastener length direction.

Further, the film member 52 has the undulated shape in the fastener length direction, so that it is possible to suppress the flexibility of the fastener stringers 10 without fastener tape from being lowered in the fastener length direction, which is caused when the film member 52 is inserted between the upper and lower leg portions 12*b*, 12*c* of the fastener elements 12.

DESCRIPTION OF REFERENCE NUMERALS

1: Garment with Slide Fastener Affixed Thereto (Garment)
5: Cloth
6: Second Sewing Thread
10: Fastener Stringer (Stringer without Fastener Tape)
11: Element Row
12: Fastener Element
12*a*: Engaging Head
12*b*: Upper Leg Portion
12*c*: Lower Leg Portion
12*d*: Connection Portion
13: First Sewing Thread
13*a*: Looper Thread
13*b*: Needle Thread
14: Tape Member (Woven Tape Member)
14*a*: Warp
14*b*: Weft
20: Stringer without Fastener Tape
22: Fastener Element
22*a*: Engaging Head
22*b*: Upper Leg Portion
22*c*: Lower Leg Portion
22*d*: Connection Portion
22*e*: Recessed Portion
30: Slider
31: Slider Body
32: Pull Tap
33: Upper Blade
34: Lower Blade
35: Guide Post
36: Lower Flange Portion
37: Ridge Portion
38: Pull Tap Attachment Portion
41: First End Stop
42: Second End Stop
51: Tape Member (Warp Knitted Tape Member)
51*a*: Chain Stitch Thread
51*b*: Tricot Knitting Thread
51*c*: Insertion Weft
52: Film Member
52*a*: Through-Hole

The invention claimed is:

1. A stringer comprising:

a plurality of continuous fastener elements formed from a mono filament, and a narrow element fixing member to which the fastener elements are sewn in series by sewing threads, wherein each of the fastener elements, formed in a coil shape, has an engaging head which is configured to engage with a facing fastener element in a fastener width direction, upper and lower leg portions extending from the engaging head in the fastener width direction, and a connection portion which extends from the upper leg portion of the continuous fastener element and the lower leg portion of an adjacent fastener element in a fastener length direction and is connected to the lower leg portion of the adjacent fastener element in the fastener length direction, wherein the element fixing member is inserted between the upper leg portions and the lower leg portions of the fastener elements along the fastener length direction, and wherein the sewing threads come in contact with and bridge over the upper leg portions and the lower leg portions of the respective fastener elements, pierce the element fixing member between the fastener elements adjacent to each other in the fastener length direction and seam the fastener elements and the element fixing member.

2. The stringer according to claim 1, wherein the element fixing member has a size in the fastener width direction twice or more as large as a size in a fastener thickness direction at an unloaded state.

3. The stringer according to claim 1, wherein the element fixing member is a tape member having a woven structure.

4. The stringer according to claim 1, wherein the element fixing member is a tape member having a warp knitted structure in which a chain stitch thread is arranged at each wale.

5. The stringer according to claim 1, wherein the element fixing member is a tape member made of non-woven fabric.

6. The stringer according to claim 1, wherein the element fixing member is a film member made of a synthetic resin.

7. The stringer according to claim 1, wherein the upper and lower leg portions are sewn to the element fixing member by a double chain stitch of the sewing threads.

8. An article with a slide fastener comprising:

a stringer;

a slider; and a fastener-attached member having an opening and closing part, wherein the stringer includes;

a plurality of continuous fastener elements formed from a mono filament, and a narrow element fixing member to which the fastener elements are sewn in series by sewing threads, wherein each of the fastener elements has an engaging head which is configured to engage with a facing fastener element in a fastener width direction, upper and lower leg portions extending from the engaging head in the fastener width direction, and a connection portion which extends from the upper leg portion of the continuous fastener elements and the lower leg portion of an adjacent fastener element in a fastener length direction and is connected to the adjacent fastener element in the fastener length direction, wherein the element fixing member is inserted between the upper leg portions and the lower leg portions of the fastener elements along the fastener length direction, wherein the sewing threads come in contact with and bridge over the upper leg portions and the lower leg portions of the respective fastener elements, pierce the element fixing member between the fastener elements adjacent to each other in the fastener length direction and seam the fastener elements and the element fixing member, one of the sewing threads bridging over the upper leg portions and the sewing threads bridging over the lower leg portions comes in contact with the fastener-attached member, and the stringer is attached to the opening and closing part of the fastener-attached member and the slider is slidably attached to an element row formed by the fastener elements.

* * * * *